US006334314B1

(12) United States Patent
Glazer et al.

(10) Patent No.: US 6,334,314 B1
(45) Date of Patent: Jan. 1, 2002

(54) CRYOSTAT NOZZLE A METHOD OF USING A CRYOSTAT

(76) Inventors: Anthony Michael Glazer, 8 Delapre Drive, Banbury, Oxon OX16 7WP; John Cosier, 12 Churchill Gate, Oxford Road, Woodstock, Oxon. OX20 1QW, both of (GB)

( * ) Notice: Subject to any disclaimer, the term of this patent is extended or adjusted under 35 U.S.C. 154(b) by 0 days.

(21) Appl. No.: 09/646,965

(22) PCT Filed: Mar. 29, 1999

(86) PCT No.: PCT/GB99/00974

§ 371 Date: Nov. 6, 2000

§ 102(e) Date: Nov. 6, 2000

(87) PCT Pub. No.: WO99/50639

PCT Pub. Date: Oct. 7, 1999

(30) Foreign Application Priority Data

Mar. 27, 1998 (GB) ..... 9806650

(51) Int. Cl.[7] ..... F25B 19/00

(52) U.S. Cl. ..... 62/51.1

(58) Field of Search ..... 62/52.1, 51.1, 62/64, 373

(56) References Cited

U.S. PATENT DOCUMENTS

| | | | |
|---|---|---|---|
| 4,295,339 | A | 10/1981 | Kuraoka et al. |
| 4,415,107 | A | 11/1983 | Palmieri |
| 5,397,059 | A | 3/1995 | Baudin |
| 5,493,865 | A | 2/1996 | Wohlwend |
| 5,653,113 | A | 8/1997 | Sawano |

FOREIGN PATENT DOCUMENTS

| | | |
|---|---|---|
| EP | 0 561 696 A1 | 9/1993 |

*Primary Examiner*—Henry Bennett
*Assistant Examiner*—Malik N. Drake
(74) *Attorney, Agent, or Firm*—Fleshner & Kim, LLP

(57) ABSTRACT

A method of using a cryostat comprises supplying a stream of cold cryogas over a specimen, and surrounding said stream in the vicinity of the specimen by a dry annular flow of the same cryogas at ambient temperature. A nozzle for the cryostat comprises a central feed tube (36) for supplying the stream of cold cryogas over a specimen (35), and an annular feed opening (34) for supplying the dry annular flow of the same cryogas at ambient temperature.

19 Claims, 2 Drawing Sheets

CRYOSTAT NOZZLE A METHOD OF USING A CRYOSTAT

TECHNICAL FIELD

The present invention relates to the use of a cryostat for maintaining a specimen at a low temperature so as to allow scientific examination or experiment to be accurately performed. More particularly, the present invention is concerned with a nozzle for use in such a cryostat.

BACKGROUND ART

X-ray crystallography is well-known as one particular scientific method in which a specimen may be subjected to a beam of x-rays with the x-ray diffraction patterns obtained being indicative of the crystalline structure of the specimen. Another known method is neutron crystallography. In general, biological samples subjected to such methods are more robust if they are frozen, and uniform results are more likely to be obtained if their temperature is kept stable. Thus, chilling of samples, for example, by the use of a cryostat, and particularly by open stream cooling, is well known. Very cold temperatures, for example those at less than the 77.4 degrees Kelvin boiling point of liquid nitrogen, are highly desirable, since they allow crystal phase changes to be studied. Such very cold temperatures are obtainable by the use of a 'cryogas', a term which in this specification is defined as meaning helium, neon or hydrogen in a gaseous or liquid phase.

U.S. Pat. No. 5,653,113 discloses a cooling system comprising a nozzle pipe for jetting low-temperature gaseous nitrogen from a tip end opening thereof, the nozzle pipe being disposed inside a cooling chamber supplied with ordinary temperature nitrogen gas. However, the system has the disadvantage of not being adapted to cool samples below the boiling point of nitrogen to temperatures at which x-ray crystallography is particularly fast and accurate.

U.S. Pat. No. 4,295,339 discloses a cryostatic system utilising a liquefied gas in which an object to be cooled in a thermostatic chamber is cooled initially by a liquid coolant at a cryogenic temperature and then by a gaseous coolant. The coolant is typically nitrogen or carbon dioxide, thus the system suffers the same disadvantages as that disclosed by U.S. Pat. No. 5,653,113, when the coolant is in its gaseous form.

It is an object of the present invention to provide an improved method of using a cryogas cryostat and an improved nozzle for use in such a cryogas cryostat.

DISCLOSURE OF INVENTION

In accordance with the present invention, a method of using a cryogas cryostat comprises supplying a stream of cryogas over a specimen, and surrounding said stream in the vicinity of the specimen by a dry annular flow of cryogas at ambient temperature, characterised in that the stream of cryogas is helium at a temperature of between 4.2 and 77.4 degrees Kelvin and the dry annular flow of cryogas is the same cryogas.

Preferably in the vicinity of the specimen there is no solid barrier between said stream and said annular flow, and the speed of flow of said stream is substantially the same as the speed of said annular flow.

Preferably further in the vicinity of the specimen there is no barrier at all between said stream and said annular flow, whereby said stream is supplied adjacent the surrounding annular flow.

Preferably further in the vicinity of the specimen there is supplied an outer annular dry ambient airflow surrounding the annular flow of ambient temperature cryogas.

Preferably further the speed of flow of said stream in the vicinity of the specimen is at least 25 cms/second.

Preferably further the speed of flow of said stream in the vicinity of the specimen is less than 10 meters/second.

Preferably further the speed of flow of said stream in the vicinity of the specimen is between about 50 cms and 1 meter/second.

Preferably the method includes positioning the cryostat in such a disposition that said stream is supplied generally downwardly.

The present invention further consists in a nozzle for a cryogas cryostat comprising a central feed tube for supplying a stream of cryogas over a specimen, and an annular feed opening for supplying a dry annular flow of cryogas at ambient temperature surrounding said stream in the vicinity of the specimen, characterised in that the stream of cryogas is a stream of helium, that the dry annular flow of cryogas is also helium, and that said cryogas cryostat also comprises means for supplying said stream of helium at a temperature of between 4.2 and 77.4 degrees Kelvin to the central feed tube and means for supplying helium at ambient temperature to the annular feed opening.

Preferably in the vicinity of the specimen there is no solid barrier between said stream and said annular flow.

Preferably also the annular feed opening is surrounded by a shield extending beyond a mounting point for the specimen.

Preferably further the shield is beryllium having a high thermal conductivity and good thermal capacity to remain above freezing point in use.

Alternatively the shield is optically transparent and the nozzle has means to supply dry ambient temperature air along the outside of the shield in the vicinity of the specimen.

Preferably the annular feed opening is connected from a corresponding annular feed chamber.

Preferably further the annular feed chamber and annular feed opening connected to it comprise a radially inner wall which is of insulating material.

Preferably further the interior of the nozzle is a vacuum chamber.

The present invention also consists in a cryostat comprising a cryostat nozzle according to any one of the preceding statements of invention.

Preferably further the cryostat is provided with a source of cryogas to be connected to the central feed tube and operable at less than 77.4 degrees Kelvin and is provided with a dry source of the same cryogas at ambient temperature to be connected to the annular feed chamber.

Other preferred features of the invention will be apparent from the following description and from the subsidiary claims of the specification.

BRIEF DESCRIPTION OF DRAWINGS

The invention will now be further described, merely by way of example and relating to the use of gaseous helium as the cryogas, by reference to the accompanying drawings, in which.

BEST MODE FOR CARRYING OUT THE INVENTION

Figure 1:
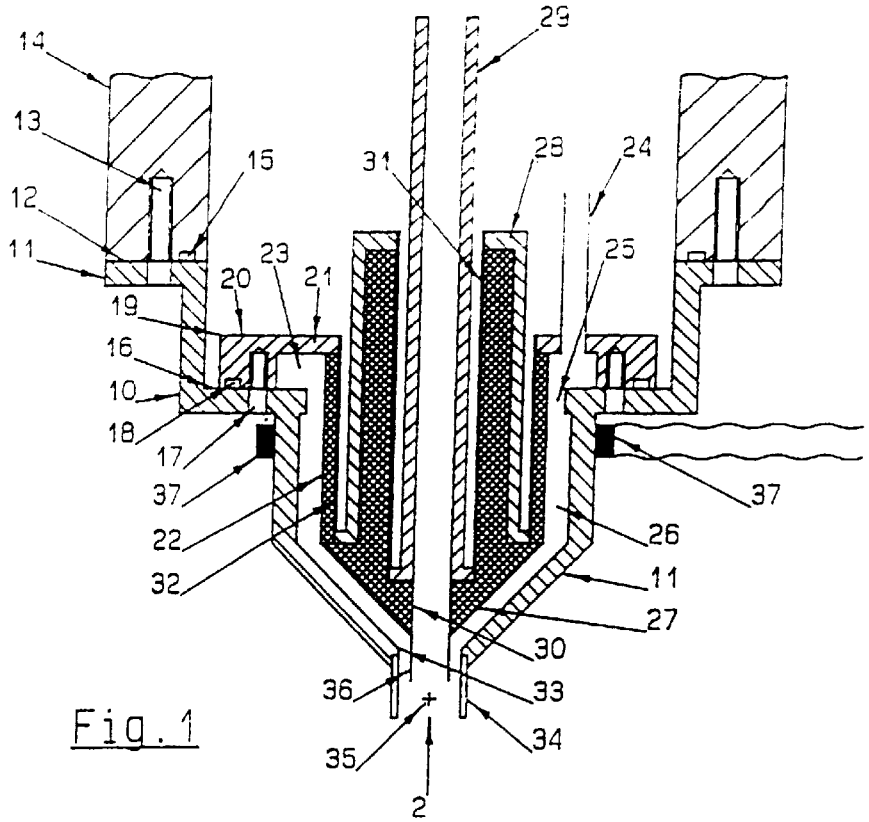
FIG. 1 is a sectioned elevation of a cryostat nozzle according to a first typical example of the invention, and taken along the line 1—1 of FIG. 2.
Figure 2:
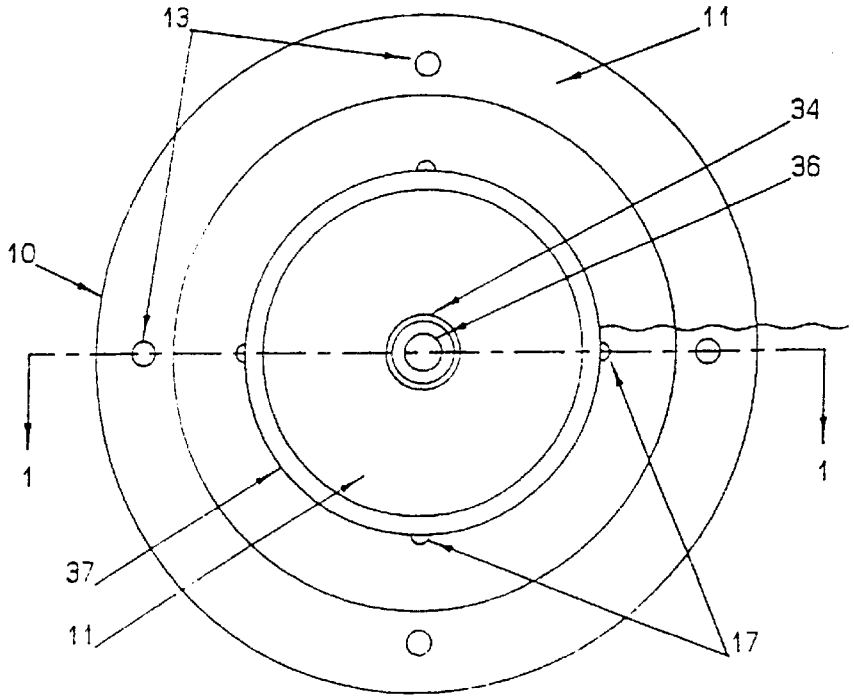
FIG. 2 is an end view taken in the direction of the arrow 2 shown on FIG. 1.

Referring to FIGS. 1 and 2 of the drawings, a cryostat nozzle 10 of the first typical example comprises a generally frustoconical ring 11 having an outer annular land 12 screwed at 13 onto the circular end of a body 14 of a cryostat and sealed thereto at 15. The ring 11 has an inner annular land 16 screwed at 17 and sealed at 18 to an outer hoop 19 of a complex collar 20.

The upper surface of the hoop 19 of the collar 20 extends inwardly in a flange 21 axially spaced from the land 16 to a downwardly extending tubular section 22. The land 16 radially inward of the hoop 19, the hoop 19 itself, the flange 21 and the tubular section 22 define an annular chamber 23 to be fed with dry helium gas at ambient temperatures, e.g. about 25 to 30 degrees Celsius, through a pipe 24 in the body 14.

In the lower radially inward region of the annular chamber 23 there is provided an annular passage 25 leading to an annular clearance 26 between the remainder of the tubular section 22, a conical lower end 27 to the collar 20 and the adjacent inner surfaces of the ring 11. Ambient temperature helium gas in the annular chamber 23 passes through the annular passage 25 and along the annular clearance 26.

The collar 20 also comprises a tubular body 28 upstanding from the conical lower end 27 and surrounding but spaced from a central feed tube 29 for supplying a stream of cold gaseous helium, usually at a temperature of less than 77.4 degrees Kelvin, from within the body 14 to an axial cylindrical hole 30 through the conical lower end 27 on which the adjacent end of the central feed tube 29 is mounted.

It is to be noted that all of the parts of the complex collar 20 which are shown cross-hatched in FIG. 1 are made of a good thermal insulating material such as expanded polystyrene foam, and in use the interior of the body 14 is evacuated, so as to minimise heat transfer from the body 14 or from the ambient temperature helium gas to the very cold helium gas in the feed tube 29 and the axial cylindrical hole 30. The tubular inner face of the tubular body 28 is provided with a sealing tube 31 of a poor thermal conductor, such as stainless steel and the tubular inner face of the tubular section 22 is provided with a sealing tube 32 of a poor thermal conductor, such as stainless steel to maintain the integrity of the vacuum in the body 14.

The tip 33 of the ring 11 opens to an axially-aligned circular tubular shield 34 of a material transparent to x-rays, e.g. beryllium. The shield 34 has an internal cross-sectional area which is approximately the same as the sum of the cross-sectional areas of the axial cylindrical hole 30 and the adjacent mouth of the annular clearance 26.

Specimen mounting means are not shown, but in this first typical example, the length of the shield 34 is about the same as its internal diameter, which is sufficient to extend beyond a specimen mounting point 35 and to allow rotation of the specimen around a range of axes within a wide cone of maneuverability defined by the specimen mounting point 35 and the circular bottom edge of the shield 34. Alternatively the shield 34 may be longer if the specimen mounting means permits. The specimen mounting point 35 is sufficiently far away from the tip 33 of the ring for the x-ray diffraction pattern emanating from the specimen to be unimpeded by the cryostat nozzle 10, passing freely through the wall of the beryllium shield 34.

The bottom edge of the axial cylindrical hole 30 is provided with an extension tube 36 of a poor thermal conductor, such as nylon. The tube 36 passes across the mouth of the annular clearance 26 to align the helium gas flows, but ends short of the specimen mounting point 35 in order not to impede the x-rays. The width of the gap between the tube 36 and the shield 34 is appropriate to maintain the integrity of the annular gas flow through it to the far end of the shield 34, i.e. between about 1 and 3 mm.

The ring 11 is provided with an electrical heater 37 wrapped around its exterior just below the inner annular land 16. The heater 37 can be powered when necessary to ensure that the ring 11, and (by thermal conduction) the shield 34 are warm enough to avoid atmospheric water condensation, e.g. about 25 to 30 degrees Celsius.

When the cryostat is used with the specimen mounted at the mounting point 35, the feed tube 29, the axial cylindrical hole 30 and the extension tube 36 supply a stream of cold gaseous helium usually at a temperature of less than 77.4 degrees Kelvin over the specimen. The speed of flow of the cold helium stream is important, preferably being at between 25 cms and 10 meters per second in the vicinity of the specimen, more preferably between about 50 cms and 1 meter per second, to provide uniform flow of helium gas of low density towards and against the higher density air beyond the shield 34, with reasonable economy of helium usage. The density of helium gas is higher at lower temperatures, which can be as low as its boiling point of 4.2 degrees Kelvin, thereby reducing the difference of densities between gaseous helium and room temperature air and allowing the speed of flow of the cold helium gas to be reduced.

At the same time, the stream of cold gaseous helium is surrounded in the vicinity of the specimen by the annular flow of dry helium gas at ambient temperature, e.g. about 25 to 30 degrees Celsius, from the annular clearance 26 and around the outside of the extension tube 36. The speed of the annular flow is preferably the same as the speed of the cold helium stream in order to match laminar flows and hence minimise mixing between the cold helium stream and the ambient helium annular flow, which mixing would begin to heat the stream of cold helium.

The ambient temperature helium annular flow alongside the inside of the shield 34 stops the latter from being chilled, and hence prevents ice formation from the surrounding environment on the shield 34 and the cryostat nozzle 10. This effect of the ambient temperature helium is supplemented by thermal conduction from the cryostat body 14, and can be boosted by the heater 37 if required. Thus not only ice but even water condensation on the shield 34 can be avoided.

Preferably the cryostat is disposed to supply the stream of cold helium generally downwardly, but perhaps at an angle of some 10 to 45 degrees to the vertical for a stable gas flow pattern, to keep good control of the helium flow and to keep air out of the shield 34.

If the specimen is to be examined by x-ray crystallography, the x-ray source is to one side of the shield 34 which does not significantly affect the x-rays incident on the specimen, or the x-rays diffracted by the specimen.

Figure 3:
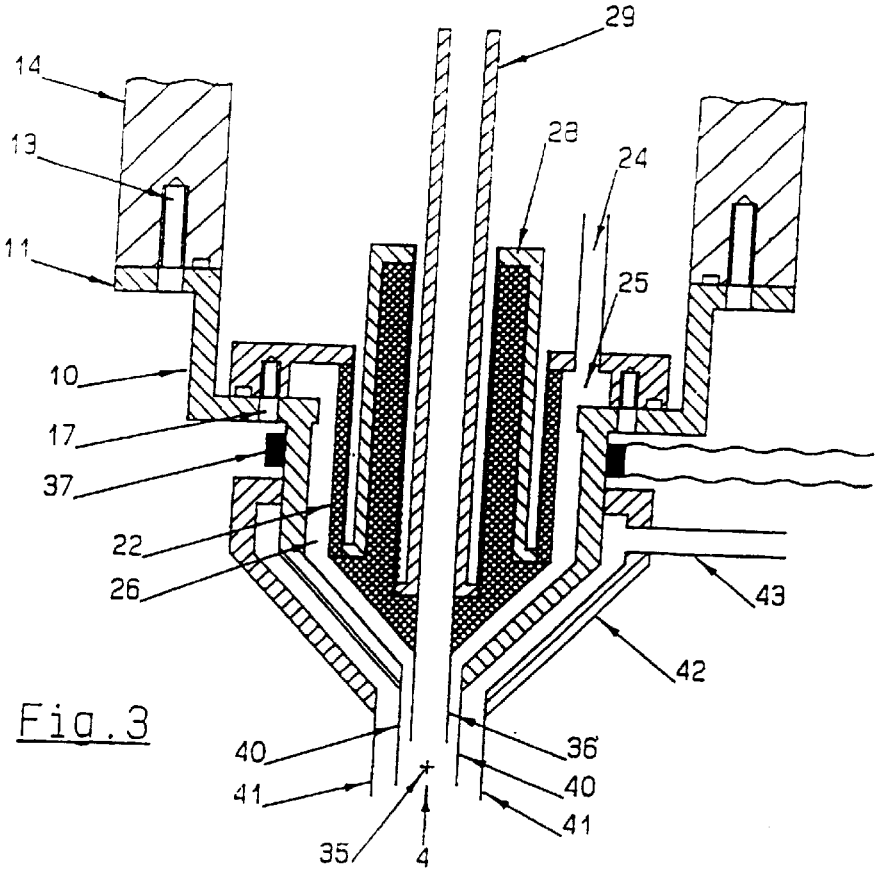
FIG. 3 is a sectioned elevation of a cryostat nozzle according to a second typical example of the invention, and taken along the line 3—3 of FIG. 4.
Figure 4:
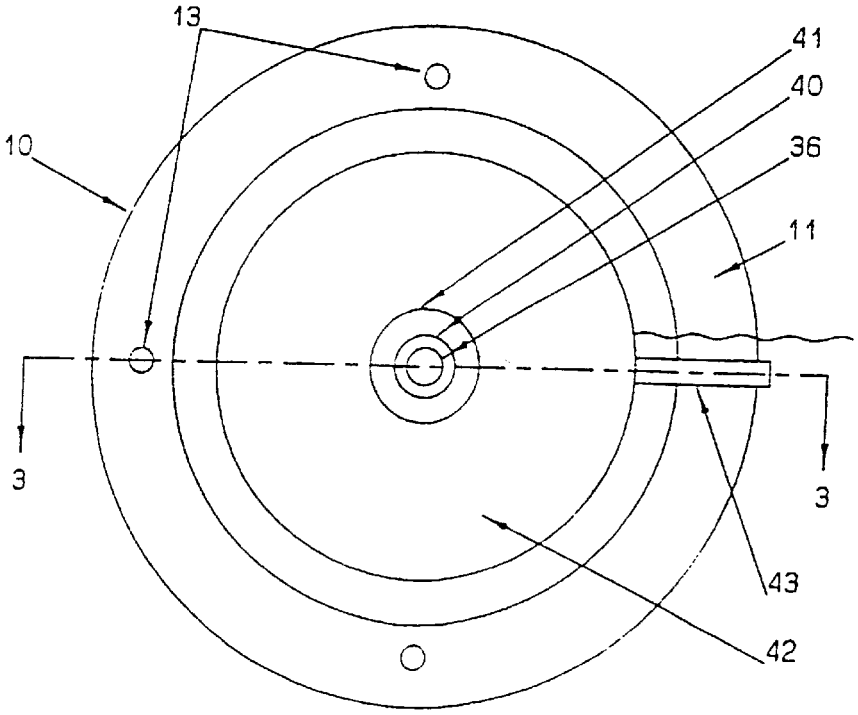
FIG. 4 is an end view taken in the direction of the arrow 4 shown on FIG. 3.

In the second typical example of the invention shown in FIGS. 3 and 4, to which reference is now made, a set of co-axial optically transparent shields 40,41 replaces the beryllium shield 34 of the first typical example. This enables a beam of light, for example from a laser, to be trained on the specimen cooled by the cryostat, and the resulting reflected, refracted or diffracted images studied. A polyamide such as "KAPTON" (Trade Mark) is preferably used, or a polyester such as "MYLAR" (Trade Mark). These plastics can be very thin, such as 0.5 mm, which means that x-ray crystallography can still be carried out with this second example without too much degradation of the x-ray diffraction patterns.

In FIGS. 3 and 4, the same reference numerals are used for the same parts as those in FIGS. 1 and 2 of the first typical example, but the beryllium shield 34 of the first typical example is changed to a "KAPTON" inner shield 40 of the same configuration, and a "KAPTON" cylindrical outer shield 41 is provided around and coaxial with the inner shield 40. The outer shield 41 is mounted on frustoconical air jacket 42 that surrounds the ring 11 below the heater 37 to feed dry ambient temperature air from a supply 43 as an outer annular dry ambient air flow between the inner shield 40 and the outer shield 41 in the vicinity of the specimen at approximately the same speed as the annular flow of ambient temperature helium beside it but on the inside of the inner shield 40.

The reason for adding the air jacket 42 and the outer shield 41 in the second typical example is that the plastics materials used for the inner shield 40 have poor thermal conductivity and low thermal capacity.

Consequently, any stray inter-mixing between the helium flows which even temporarily chills a portion of the plastic inner shield 40 would cause condensation or freezing if moisture-laden ambient air were present, whereas the high thermal conductivity and relatively good thermal capacity of much thicker beryllium prevents this from happening in the first typical example.

The uniform speed of flow for all of the gas streams reduces turbulence and promotes laminar flow when their separation by the shields ceases, keeping the nature and integrity of each of the gas streams over and for as far as possible away from the specimen mounting point 35.

Gaseous helium has been used as the cryogas in the descriptions of the first and second typical examples above, but at about 4.2 degrees Kelvin helium may be used in mixed phases with droplets of liquid helium dispersed in gaseous helium. Helium may also be used as a liquid as long as the specimen is adequately mounted.

What is claimed is:

1. A method of using a cryogas cryostat comprising supplying a stream of cryogas over a specimen, and surrounding said stream in the vicinity of the specimen by a dry annular flow of cryogas at ambient temperature; characterised in that the stream of cryogas is helium at a temperature of between 4.2 and 77.4 degrees Kelvin and the annular flow of cryogas is the same cryogas.

2. A method according to claim 1 wherein in the vicinity of the specimen there is no solid barrier between said stream and said annular flow, and the speed of flow of said stream is substantially the same as the speed of said annular flow.

3. A method according to claim 2 wherein in the vicinity of the specimen there is no barrier at all between said stream and said annular flow, whereby said stream is supplied adjacent the surrounding annular flow.

4. A method according to claim 1 wherein in the vicinity of the specimen there is supplied an outer annular dry ambient air flow surrounding the annular flow of ambient temperature cryogas.

5. A method according to claim 1 wherein the speed of flow of said stream in the vicinity of the specimen is at least 25 cms/second.

6. A method according to claim 5 wherein the speed of flow of said stream in the vicinity of the specimen is between about 50 cms and 1 meter/second.

7. A method according to claim 1 wherein the speed of flow of said stream in the vicinity of the specimen is less than 10 meters/second.

8. A method according to claim 7 wherein the speed of flow of said stream in the vicinity of the specimen is between about 50 cms and 1 meter/second.

9. A method according to claim 1 including positioning the cryostat in such a disposition that said stream is supplied generally downwardly.

10. A cryogas cryostat comprising a nozzle having a central feed tube for supplying a stream of cryogas over a specimen, and an annular feed opening for supplying a dry annular flow of cryogas at ambient temperature surrounding said stream in the vicinity of the specimen characterised in that the stream of cryogas is a stream of helium, that the dry annular flow of cryogas is also helium, and that said cryogas cryostat also comprises means for supplying said stream of helium at a temperature of between 4.2 and 77.4 degrees Kelvin to the central feed tube and means for supplying helium at ambient temperature to the annular feed opening.

11. A cryostat according to claim 10 wherein in the vicinity of the specimen there is no solid barrier between said stream and said annular flow.

12. A cryostat according to claim 11 wherein the annular feed opening is surrounded by a shield extending beyond a mounting point for the specimen.

13. A cryostat according to claim 10 wherein the annular feed opening is surrounded by a shield extending beyond a mounting point for the specimen.

14. A cryostat according to claim 13 wherein the shield is beryllium having a high thermal conductivity and good thermal capacity to remain above freezing point in use.

15. A cryostat according to claim 13 wherein the shield is optically transparent and the nozzle has means to supply dry ambient temperature air along the outside of the shield in the vicinity of the specimen.

16. A cryostat according to any one of claim 10 wherein the annular feed opening is connected from a corresponding annular feed chamber.

17. A cryostat according to claim 16 wherein the annular feed chamber and annular feed opening connected to it comprise a radially inner wall which is of insulating material.

18. A cryostat according to claim 10 wherein the interior of the nozzle is a vacuum chamber.

19. Use of a cryogas cryostat as claimed in claim 10 in x-ray crystallographical analysis of a specimen.

* * * * *